US009706295B2

(12) United States Patent
Pommerer et al.

(10) Patent No.: US 9,706,295 B2
(45) Date of Patent: Jul. 11, 2017

(54) SYSTEM FOR INFLUENCING EXHAUST NOISE IN A MULTI-FLOW EXHAUST SYSTEM

(71) Applicant: Eberspächer Exhaust Technology GmbH & Co. KG, Neunkirchen (DE)

(72) Inventors: Michael Pommerer, Uhingen (DE); Juergen Kobe, Nuertingen-Raidwangen (DE); Ralf Hoelsch, Epfendorf (DE); Peter Wink, Goeppingen (DE)

(73) Assignee: Eberspächer Exhaust Technology GmbH & Co. KG, Neunkirchen (DE)

( * ) Notice: Subject to any disclaimer, the term of this patent is extended or adjusted under 35 U.S.C. 154(b) by 403 days.

(21) Appl. No.: 14/313,334

(22) Filed: Jun. 24, 2014

(65) Prior Publication Data

US 2014/0376733 A1 Dec. 25, 2014

(30) Foreign Application Priority Data

Jun. 25, 2013 (DE) ..... 10 2013 010 609

(51) Int. Cl.

| | |
|---|---|
| ***H04R 3/00*** | (2006.01) |
| ***F01N 13/04*** | (2010.01) |
| ***F01N 1/06*** | (2006.01) |
| ***F01N 13/00*** | (2010.01) |

(52) U.S. Cl.

CPC ..... *H04R 3/002* (2013.01); *F01N 1/06* (2013.01); *F01N 1/065* (2013.01); *F01N 13/011* (2014.06); *F01N 13/04* (2013.01)

(58) Field of Classification Search

CPC ..... H04R 3/002
USPC ..... 381/71.4, 71.5, 174
See application file for complete search history.

(56) References Cited

U.S. PATENT DOCUMENTS

| | | | |
|---|---|---|---|
| 4,177,874 | A | 12/1979 | Angelini et al. |
| 5,229,556 | A | 7/1993 | Geddes |
| 5,233,137 | A | 8/1993 | Geddes |
| 5,336,856 | A | 8/1994 | Krider et al. |

(Continued)

FOREIGN PATENT DOCUMENTS

| | | | |
|---|---|---|---|
| CN | 102750943 | A | 10/2012 |
| CN | 102808681 | A | 12/2012 |

(Continued)

OTHER PUBLICATIONS

Chinese Office Action of Feb. 26, 2016.
Japanese Office Action of May 14, 2015.
European Office Action of Oct. 14, 2014.

*Primary Examiner* — Md S Elahee
(74) *Attorney, Agent, or Firm* — McGlew and Tuttle, P.C.

(57) ABSTRACT

An anti-noise system for influencing exhaust noises propagating through a multi-flow exhaust system includes a controller 80 and at least one actuator. The at least one actuator is disposed in a sound generator 20; 21; 23; 25; 27, connected to the controller 80 for receiving control signals, and adapted to generate sound inside the sound generator 20; 21; 23; 25; 27. The sound generator 20; 21; 23; 25; 27 is connectable to at least two exhaust tracts 60, 61 of the multi-flow exhaust system of the vehicle simultaneously. The controller 80 is configured to generate a control signal that prompts the at least one actuator disposed in the sound generator 20; 21; 23; 25; 27 to cancel sound inside the at least two exhaust tracts 60, 61 of the vehicle's multi-flow exhaust system at least in part and preferably completely.

20 Claims, 3 Drawing Sheets

(56) References Cited

U.S. PATENT DOCUMENTS

| | | | |
|---|---|---|---|
| 5,343,533 | A | 8/1994 | Geddes |
| 5,432,857 | A | 7/1995 | Geddes |
| 5,600,106 | A | 2/1997 | Langley |
| 5,619,020 | A | 4/1997 | Jones et al. |
| 5,703,337 | A | 12/1997 | Geisenberger |
| 2006/0037808 | A1 | 2/2006 | Krueger et al. |
| 2008/0053747 | A1 | 3/2008 | Krueger et al. |
| 2009/0255754 | A1 | 10/2009 | Krueger et al. |
| 2011/0000734 | A1 | 1/2011 | Krueger et al. |
| 2012/0288111 | A1 | 11/2012 | Luecking et al. |
| 2012/0308023 | A1 | 12/2012 | Luecking et al. |

FOREIGN PATENT DOCUMENTS

| | | | |
|---|---|---|---|
| DE | 197 51 596 | A1 | 6/1999 |
| DE | 101 37 239 | A1 | 2/2002 |
| DE | 10 2006 042 224 | B3 | 1/2008 |
| DE | 10 2008 018 085 | A1 | 10/2009 |
| DE | 10 2009 031 848 | A1 | 1/2011 |
| DE | 100 85 230 | B3 | 3/2012 |
| DE | 10 2011 089283 | A1 | 6/2013 |
| EP | 0 481 450 | A1 | 4/1992 |
| EP | 0 373 188 | B1 | 12/1993 |
| EP | 0 674 097 | A1 | 9/1995 |
| EP | 0 755 045 | A2 | 1/1997 |
| EP | 0840285 | A2 | 5/1998 |
| EP | 0 916 817 | A2 | 5/1999 |
| EP | 1 055 804 | A1 | 11/2000 |
| EP | 1 627 996 | A1 | 2/2006 |
| EP | 2530263 | A1 | 12/2012 |
| JP | H08305374 | A | 11/1996 |
| JP | 2012-251554 | A | 12/2012 |
| WO | 01/38700 | A1 | 5/2001 |

SYSTEM FOR INFLUENCING EXHAUST NOISE IN A MULTI-FLOW EXHAUST SYSTEM

CROSS REFERENCE TO RELATED APPLICATIONS

The present application claims priority of German Patent Application DE 10 2013 010 609.5, filed Jun. 25, 2013 in Germany, the entire contents of which are incorporated by reference herein.

FIELD OF THE INVENTION

The invention relates to a system for influencing sound waves propagating through exhaust systems of vehicles driven by internal combustion engines (exhaust noises). More specifically, the present invention relates to a system for influencing the sound waves propagating through multi-flow exhaust systems.

BACKGROUND OF THE INVENTION

Multi-flow exhaust systems are used for reliably discharging high volume exhaust gas flows with little resistance. High volume exhaust gas flows occur in particular with powerful engines. It is characteristic for multi-flow exhaust systems that exhaust gas from the internal combustion engine and exhaust gas passing through the exhaust system is discharged into the surroundings via at least two tailpipes of the exhaust system.

Regardless of an internal combustion engine's construction (for instance reciprocating piston engine, pistonless rotary engine or free-piston engine), noises are generated as a result of the successively executed strokes (in particular intake and compression of the fuel-air mixture, combustion and discharge of the combusted fuel-air mixture). On the one hand, the noises propagate through the internal combustion engine in the form of solid-borne sound and are emitted on the outside of the internal combustion engine in the form of airborne sound. On the other hand, the noises propagate in the form of airborne sound together with the combusted fuel-air mixture through an exhaust system that is in fluid communication with the internal combustion engine.

These noises are often regarded as being disadvantageous. On the one hand, there are statutory provisions on protection against noise to be observed by manufacturers of vehicles driven by internal combustion engines. These statutory provisions normally specify a maximum allowable sound pressure for an operation of a vehicle. Manufacturers, on the other hand, try to impart a characteristic noise emission to internal combustion engine driven vehicles of their production, with the noise emission fitting the image of the respective manufacturer and being popular with customers. Present-day engines with small displacement often cannot naturally generate such intended characteristic noise.

The noises propagating through the internal combustion engine in the form of solid-borne sound can be muffled quite well and are thus usually no problem as far as protection against noise is concerned. With the increasing use of internal combustion engines having small displacements or even of electric motors, the problem arises that the engine (or motor) noise is often not attractive for users and/or does not fit the image of a vehicle manufacturer.

The noises traveling together with the combusted fuel-air mixture in the form of airborne sound through the exhaust system of the internal combustion engine are reduced by exhaust mufflers located ahead of the exhaust system's discharge opening and downstream of catalytic converters if present. Respective mufflers may for instance work according to the absorption and/or reflection principle. The disadvantage of both operating principles is that they require a comparatively large volume and create a comparatively high resistance to the combusted fuel-air mixture resulting in a drop of the vehicle's overall efficiency and an increased fuel consumption.

For quite some time, so-called anti-noise (anti-sound) systems have been developed as an alternative or supplement to mufflers, which superimpose electro-acoustically generated anti-noise on airborne noise generated by the internal combustion engine and propagated through the exhaust system. Respective systems are for instance known from the following documents: U.S. Pat. Nos. 4,177,874, 5,229,556, 5,233,137, 5,343,533, 5,336,856, 5,432,857, 5,600,106, 5,619,020, EP 0 373 188, EP 0 674 097, EP 0 755 045, EP 0 916 817, EP 1 055 804, EP 1 627 996, DE 197 51 596, DE 10 2006 042 224, DE 10 2008 018 085 and DE 10 2009 031 848.

Respective anti-noise systems typically use a so-called Filtered-X, Least Mean Squares (FxLMS) algorithm trying to turn an error signal measured with an error microphone by outputting acoustic noise with at least one loudspeaker being in fluid communication with the exhaust system down to zero (in the case of noise-cancellation) or to a preset threshold (in the case of influencing noise). For achieving a completely destructive interference between the sound waves propagating through the exhaust system and the anti-noise generated by the loudspeaker, the sound waves originating from the loudspeaker have to match the sound waves propagating through the exhaust system in amplitude and frequency, however, with a relative phase shift of 180 degrees. If the anti-noise sound waves generated at the loudspeaker match the sound waves of the airborne sound propagating through the exhaust system in frequency and have a phase shift of 180 degrees relative thereto, but do not match the sound waves in amplitude, only an attenuation of the sound waves of the airborne sound propagating through the exhaust system is achieved. The anti-noise is calculated separately for each frequency band of the airborne noise propagating through the exhaust pipe using the FxLMS-algorithm by determining a proper frequency and phasing of two sine oscillations being shifted with respect to each other by 90 degrees, and by calculating the required amplitudes for these sine oscillations. The objective of anti-noise systems is that the cancellation or influencing of sound is audible and measurable at least outside of, but, as the case may be, also inside the exhaust system. The term "anti-noise" used in this document serves for distinguishing sound output by the at least one loudspeaker of an anti-noise system against airborne sound propagating through the exhaust system as a result of the successively executed strokes of the combustion engine. In itself, anti-noise is simple airborne sound. It is pointed out that the present document is not limited to a use of an FxLMS algorithm.

An exhaust system involving an anti-noise-system according to the prior art is explained below with reference to FIGS. 1 and 2.

An exhaust system featuring an anti-noise-system 1 comprises a sound generator 2 in the form of a soundproofed housing which contains a loudspeaker 3 and which is connected to an exhaust system 6 in the region of a tailpipe 4.

The tailpipe 4 includes a discharge opening 5 for discharging exhaust gas passing through the exhaust system to the environment.

An error microphone 7 in the form of a pressure sensor is provided at the tailpipe 4. The error microphone 7 measures the pressure variations and thus the noise inside the tailpipe 4 in a section downstream of a region providing the fluid connection between the exhaust system 6 and the sound generator 2. The term "downstream" hereby relates to the direction of the exhaust gas flow. The direction of the exhaust gas flow is indicated by arrows in FIG. 2.

The loudspeaker 3 and the error microphone 7 are electrically connected to an (anti-noise) controller 8. Further, the controller 8 is connected to an engine control unit 9 of an internal combustion engine 10 via a CAN data bus.

Using a Filtered-x Least Means Squares (FxLMS) algorithm, the anti-noise controller 8 calculates a digital control signal for a loudspeaker 3 based on the noise measured with the error microphone 7 and based on the operating parameters of the combustion engine 10 received via the CAN data bus, whereby the digital control signal enables a substantial silencing of the noise propagating through the interiors of the exhaust system 6 by application of anti-noise and is provided to loudspeaker 3.

It is a disadvantage of already known systems for influencing exhaust noise that these systems are not designed for multi-flow exhaust systems.

SUMMARY OF THE INVENTION

Embodiments of the present invention provide an anti-noise system for influencing exhaust gas noises propagating through multi-flow exhaust systems, the anti-noise system being of low complexity and low cost.

Embodiments concern an anti-noise system for influencing exhaust noises propagating through a multi-flow exhaust system. The system comprises a controller and at least one actuator. The actuator is configured to receive a control signal and to generate sound subject to the control signal. The actuator may in particular be a loudspeaker, and further in particular, a voice coil loudspeaker. The at least one actuator is disposed within a sound generator. A plurality of sound generators may be provided, each having at least one actuator disposed therein. The at least one actuator is, for example, in communication with the controller for receiving control signals via optical and/or electrical lines, and is configured for generating sound in the sound generator. Thus, sound subject to the control signal received by the controller is generated in the sound generator. The sound generator is also configured for being connected with at least two exhaust tracts of the multi-flow exhaust system of the vehicle at the same time. The controller is configured and thus configured by software to generate a control signal that prompts the at least one actuator disposed in the sound generator to cancel sound inside the at least two exhaust tracts of the vehicle's multi-flow exhaust system at least in part and preferably completely in amplitude.

As a consequence, the sound generator is assigned to at least two exhaust tracts of the multi-flow exhaust system simultaneously and fills them with sound via a fluid connection. In a multi-flow exhaust system it is therefore not necessary to provide a separate sound generator with at least one actuator for each of the exhaust tracts. Accordingly, only one controller is required. This saves installation space and cost, and reduces the complexity of the construction.

A multi-flow exhaust system is understood in this document to be an exhaust system having at least two tailpipes that are in fluid communication or are adapted to be brought into fluid communication with the combustion chambers of an internal combustion engine. The exhaust system may for instance have exactly two tailpipes or have at least one pair of tailpipes being in fluid communication with the combustion chambers of an internal combustion engine or being adapted to be in fluid communication with the combustion chambers of an internal combustion engine.

According to an embodiment, the anti-noise system further comprises at least one error microphone connected to the controller. The error microphone is configured to measure sound in the interior of the exhaust system and to output a corresponding measurement signal to the controller via optical or electrical lines. The controller is configured to cancel measurement signals received from the error microphone at least in part, and preferably completely by outputting the control signal to the at least one actuator. This is achieved indirectly by canceling the sound, measured by the error microphone and passing the exhaust system, in amplitude at least in part or completely.

According to an embodiment, the at least one error microphone is connectable simultaneously to at least two exhaust tracts of the multi-flow exhaust system of the vehicle at a position located with respect to the exhaust gas flow in a section of the fluid connection between the sound generator and the exhaust system by an additional tube.

The error microphone is thus associated with at least two exhaust tracts of the multi-flow exhaust system simultaneously so that only one closed-loop control circuit is required. This reduces the complexity of the construction.

According to an embodiment, the fluid connection of the error microphone to the at least two exhaust tracts is implemented by two tubes that are in particular flexible, and that have in particular the same length, whereby the two tubes are connected to each other using a T-pipe or a Y-pipe, and whereby the free end of each tube is connected to an exhaust tract. The error microphone is then located on the remaining leg of the T-pipe or Y-pipe, respectively.

According to an alternative embodiment, at least one error microphone is provided for each exhaust tract of the exhaust system, whereby the error microphone is only connectable to the associated exhaust tract of the vehicle's multi-flow exhaust system and is located at a position of the exhaust system in the section of a fluid connection between the sound generator and the exhaust system. According to an embodiment, the error microphone may be connectable at a position of the exhaust system downstream the section of a fluid connection between the sound generator and the exhaust system with respect to the exhaust gas flow.

Hence, a separate error microphone may be provided for each exhaust tract. According to an embodiment, the measurement values from said error microphones are averaged, and a measurement signal corresponding to the average value is output to the controller. In this manner, only one closed loop circuit may be provided, even, when several error microphones are present.

According to an embodiment, the controller is connectable to an engine control unit of a vehicle's internal combustion engine and configured (and thus configured by software) to generate the digital control signal subject to signals received from the engine control unit. Said signals received from the engine control unit may for instance contain engine speed and/or torque of the internal combustion engine.

According to an embodiment, the system includes exactly one actuator and accordingly exactly one sound generator.

According to an embodiment, the system includes exactly one error microphone.

According to an embodiment, the system includes exactly one controller.

According to an embodiment, the sound generator comprises a twin D-pipe, with both D-pipes of the twin D-pipe being simultaneously in fluid communication with a shared internal volume of the sound generator, and with each D-pipe of the twin D-pipes being connectable to exactly one exhaust tract of the vehicle's multi-flow exhaust system. Twin D-pipes are formed by two pipes of semicircular cross-section put together at their respective flat sides and joint at the longitudinal edges by, for instance, a welding seam.

According to an alternative embodiment, the sound generator comprises a Y-pipe, with one leg of the Y-pipe being in fluid communication with the interior volume of the sound generator and each other leg of the Y-pipe is connectable with exactly one exhaust tract of the vehicle's multi-flow exhaust system.

According to a further alternative embodiment, the sound generator comprises an antechamber volume into which several connection pipes enter at the same time, whereby each connection pipe is connectable to exactly one associated exhaust tract of the vehicle's multi-flow exhaust system.

According to an embodiment, the at least one sound generator is a loudspeaker housing containing at least one loudspeaker.

Embodiments of a multi-flow exhaust system for a vehicle comprise at least two exhaust tracts, and in particular at least one pair of exhaust tracts, and further in particular exactly two exhaust tracts, and an anti-noise system as described above. The at least two exhaust tracts are connectable to an internal combustion engine of the vehicle and adapted to have the exhaust gas discharged from the internal combustion engine pass through them. The at least two exhaust tracts each include a tailpipe through which exhaust gas passing the respective exhaust tract is discharged from the exhaust system. The sound generator is at the same time connected to the at least two exhaust tracts of the vehicle's multi-flow exhaust system.

According to an embodiment, the anti-noise system of the multi-flow exhaust system comprises at least one error microphone being, with respect to the exhaust gas flow, simultaneously connected by an additional pipe to at least two exhaust tracts of the vehicle's multi-flow exhaust system at a position of the exhaust system located in the section of a fluid connection between the sound generator and the exhaust system.

According to an embodiment, the anti-noise system of the multi-flow exhaust system comprises at least one error microphone for each exhaust tract of the exhaust system, the error microphone being, with respect to the exhaust gas flow, only connected to the one associated exhaust tract of the vehicle's multi-flow exhaust system at a position of the exhaust system located in a section of a fluid connection between the sound generator, and the exhaust system.

According to an embodiment, the lengths of all of the at least two exhaust tracts of the multi-flow exhaust system between the internal combustion engine and the position along the respective exhaust tract, at which the sound generator is connected to the respective exhaust tract, are identical. Alternatively, differences in length of less than 10%, and in particular of less than 5%, and further in particular of less than 3% are allowed. Further, also the lengths of the respective conduits between a respective exhaust tract and the sound generator is identical. Alternatively, differences in length of less than 10%, and in particular of less than 5%, and further in particular of less than 3% are allowed. Differences in the time required for sound to propagate through the exhaust tracts due to different lengths of the conduits are hereby prevented.

According to an embodiment, the at least two exhaust tracts of the multi-flow exhaust system comprise a shared (common) volume located upstream of the section of the fluid connection between the sound generator and the exhaust system and downstream of the internal combustion engine with respect to the flow direction of the exhaust gas passing through the exhaust tracts. This shared volume ensures that the phases of the two sound waves propagating through the at least two exhaust tracts are substantially identical. Said shared volume may for instance be provided in a turbocharger region.

According to an embodiment, the at least two exhaust tracts comprise a common volume located upstream of the tailpipes and downstream of the internal combustion engine with respect to the direction of flow of the exhaust gas passing through the exhaust tracts. The sound generator is disposed in the region of the common volume and thus connected simultaneously to the at least two exhaust tracts of the multi-flow exhaust system of the vehicle. The common volume may for instance be provided in a turbocharger region. There is hereby no need for the sound generator to be disposed in the common volume. It is sufficient for the sound generator to be in fluid connection/communication with the common volume.

According to an embodiment, each of the at least two exhaust tracts of the multi-flow exhaust system comprises a separate muffler (for example a premuffler and/or an intermediate muffler) and/or a separate emission control system (for instance a catalytic converter). The separate muffler and/or separate emission control system is located between the internal combustion engine and/or the common volume (located upstream of the section of the fluid connection between the sound generator and the exhaust system and downstream of the internal combustion engine) and the position along the respective exhaust tract where the sound generator is connected to the respective exhaust tract. Only the exhaust gas passing through the associated exhaust tract flows through the separate muffler and emission control system, respectively.

Embodiments of a motor vehicle comprise an internal combustion engine with an engine control unit and a multi-flow exhaust system as described above. The multi-flow exhaust system is in fluid communication with the internal combustion engine and in particular with the combustion chambers of the internal combustion engine. The controller of the anti-noise system of the multi-flow exhaust system is connected to the engine control unit of the internal combustion engine of the vehicle.

Embodiments of a method for controlling an anti-noise system for influencing exhaust noise propagating through a vehicle's multi-flow exhaust system comprise the following steps:

Receiving an operating parameter (like for instance engine speed and/or torque) from an engine control unit of the vehicle. Additionally or alternatively, sound may be measured inside the exhaust system. Then, a control signal is calculated based on the operating parameter and/or the sound measured, with the sound signal being adapted to cancel the airborne sound generated by the internal combustion engine and passing through at least two exhaust tracts of the multi-flow exhaust system in amplitude at least in part and preferably completely. Then, an airborne anti-noise is generated by operating at least one actuator with the control signal, and anti-noise is supplied simultaneously to at least two exhaust tracts of the multi-flow exhaust system, in order to cancel the sound generated by the internal combustion engine and passing through the at least two exhaust tracts in amplitude at least partially and preferably completely. The anti-noise system may for instance be the above anti-noise system.

Embodiments of a use of an anti-noise system for influencing exhaust noise passing through a multi-flow exhaust system of a vehicle comprise the following steps: Providing an anti-noise-system as described above; coupling the sound generator to at least two exhaust tracts of the multi-flow exhaust system of a vehicle. Thus, the sound generator is used such that is in fluid communication with at least two exhaust tracts simultaneously.

Further it is noted that the terms "including", "comprising", "containing", "having" and "with", as well as grammatical modifications thereof used in this specification or the claims for listing features, are generally to be considered to specify a non-exhaustive listing of features like for instance method steps, components, ranges, dimensions or the like, and do by no means preclude the presence or addition of one or more other features or groups of other or additional features.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

The forgoing as well as other advantageous features of the disclosure will be more apparent from the following detailed description of exemplary embodiments together with the claims and the Figures. In the Figures, like or similar elements are indicated by like or similar reference signs. It is noted that the invention is not limited to the embodiments of the exemplary embodiments described, but is defined by the scope of the enclosed claims, and that not all possible embodiments necessarily exhibit each and every, or any, of the advantages identified herein. In particular, embodiments according to the invention may implement individual features in a different number and combination than the examples instanced below. In the following explanation of exemplary embodiments of the invention, it is referred to the enclosed Figures, of which:

DETAILED DESCRIPTION OF EXEMPLARY EMBODIMENTS

Hereinafter, several embodiments of the present invention are explained with respect to the Figures.

Figure 1:
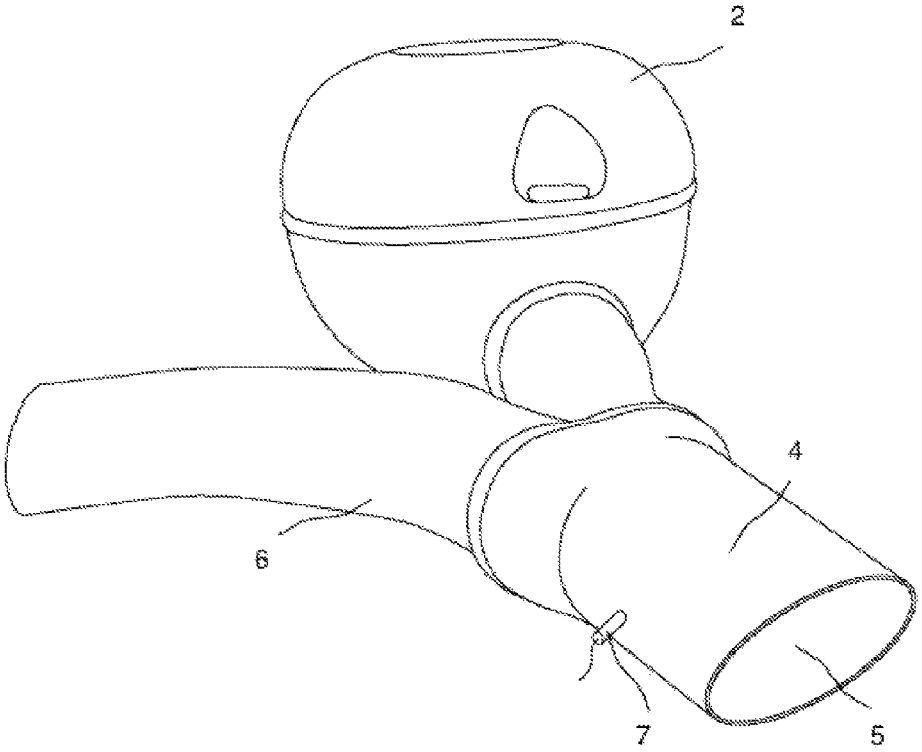
FIG. 1 is a schematic illustration showing a perspective view of a part of an exhaust system that comprises a sound generator of an anti-noise system.
Figure 2:
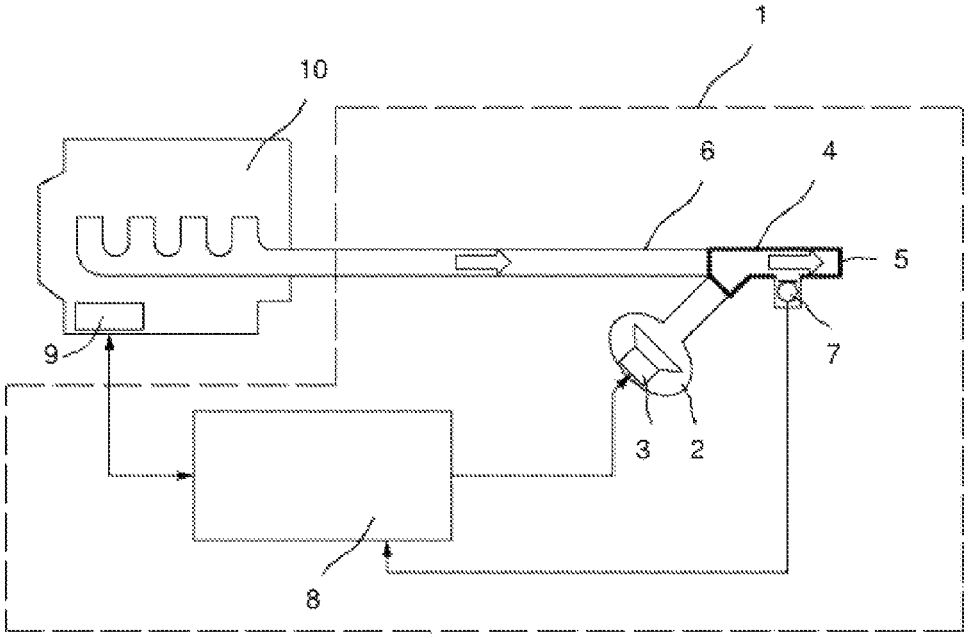
FIG. 2 is a schematic illustration showing a block diagram of an anti-noise system cooperating with an exhaust system of an internal combustion engine according to the prior art, wherein the sound generator of FIG. 1 may be used.
Figure 3A:
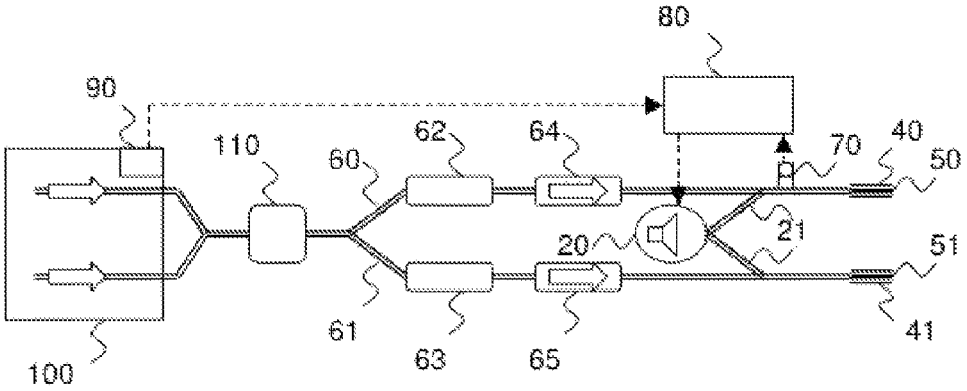
FIG. 3A is a schematic illustration showing an anti-noise system cooperating with an exhaust system of an internal combustion engine according to one of three embodiments of the invention.
Figure 3B:
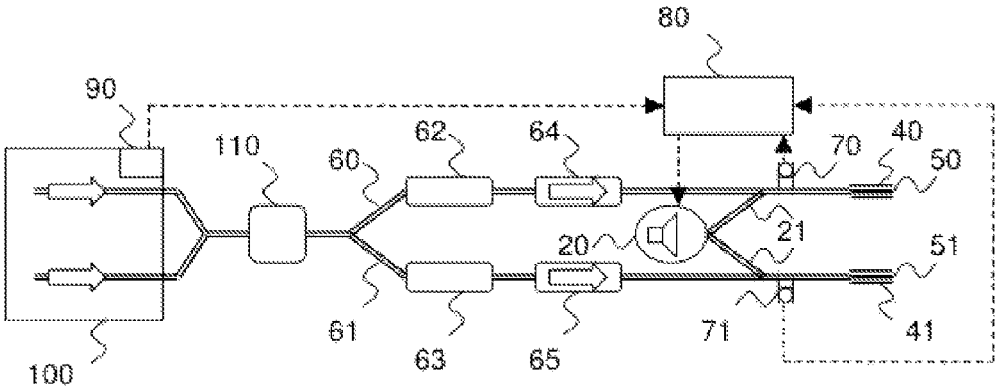
FIG. 3B is a schematic illustration showing an anti-noise system cooperating with an exhaust system of an internal combustion engine according to another of three embodiments of the invention.
Figure 3C:
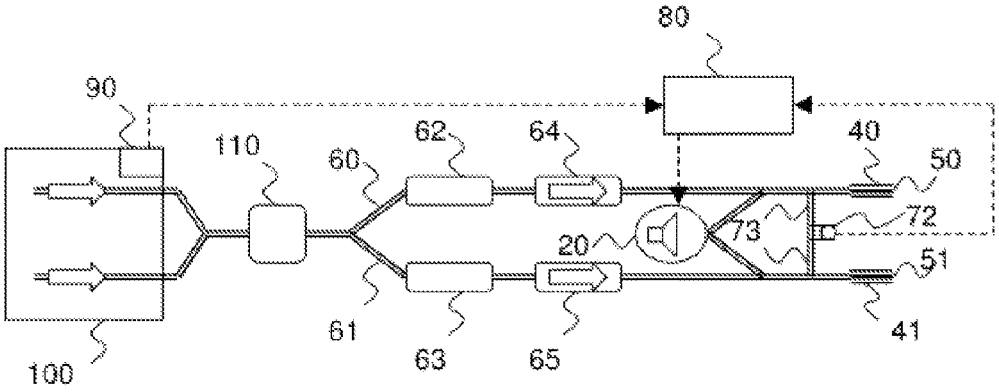
FIG. 3C is a schematic illustration showing an anti-noise system cooperating with an exhaust system of an internal combustion engine according to another of three embodiments of the invention.

Referencing FIGS. 3A, 3B, 3C, the exhaust gas streams generated by an internal combustion engine 100 are first combined and then supplied to a turbocharger 110. Afterwards, the exhaust gas is separately passed along two exhaust tracts 60, 61 through two catalytic converters 62, 63 and two premufflers 64, 65, and finally discharged to the surroundings through discharge openings 50, 51 of tail pipes 40, 41. The direction of flow of the exhaust gas is indicated by arrows.

It is noted that the turbocharger 110, the catalytic converters 62, 63, and the premufflers 64, 65 are only optional. Alternatively or additionally, other elements may also be provided for emission control and sound absorption. It is further noted that there may be more than one pair of exhaust tracts.

According to the embodiments of all FIGS. 3A, 3B, and 3C, the anti-noise system comprises a sound generator 20 with a loudspeaker disposed therein. Close to the tailpipes 50, 51, the sound generator 20 is in fluid communication with the two exhaust tracts 60, 61 via conduits 21.

The lengths of the two exhaust tracts 60, 61 between the internal combustion engine 100 and the position on the respective exhaust tract 60, 61, where the sound generator 20 is connected to the respective exhaust tract 60, 61, are identical. This is, however, not mandatory.

According to the embodiments of all FIGS. 3A, 3B, 3C, at least one error microphone 70, 71, 72 formed by a pressure sensor is disposed between the region, where the sound generator is fluidly connected, and the tailpipes 50, 51.

According to the embodiment of FIG. 3A, only one error microphone 70 is provided for measuring the pressure fluctuations and thus sound inside the exhaust tract 60.

According to the embodiment of FIG. 3B, each exhaust tract 60, 61 comprises an error microphone 70, 71 for measuring pressure fluctuations and thus sound inside the associated exhaust tract 60, 61.

According to the embodiment of FIG. 3, only one error microphone 72 is provided which simultaneously is in fluid communication with the two exhaust tracts 60, 61 via a T-shaped hose connection 73, and which simultaneously measures pressure fluctuations and thus sound inside the two exhaust tracts 60, 61.

The loudspeakers of the sound generators 20 and the error microphones 70, 71, 72 are connected to an anti-noise controller 80 by control lines.

The anti-noise controller 80 is further connected to an engine control unit 90 of the internal combustion engine 100 via a CAN data bus, and receives from the engine control unit 90 up-to-date operating parameters of the internal combustion engine 100, in particular engine speed and torque. It is noted that a different vehicle data bus may be used instead of the CAN data bus, in particular a LIN data bus, a MOST data bus, or a FlexRay data bus.

The anti-noise controller 80, which is in the present case a microprocessor configured by software, is adapted to generate a control signal based on the operating parameters of the internal combustion engine received by the engine control unit 90 and on error signals (measurement signals) received from the error microphones 70, 71, 72 by using a Filtered-X, Least Mean Squares (FxLMS) algorithm, whereby the control signal is adapted to operate the loudspeaker of the sound generator 20 such that the noise passing through the exhaust tracts 60, 61 is canceled in amplitude at least in part. The result in view of noise cancellation can be verified by the error microphones 70, 71, 72.

As is evident from FIGS. 4A, 4B, 4C, 4D and 4E, the connection of the sound generator 20 to the two exhaust tracts 60, 61 can be implemented differently in each of the embodiments described above.

Figure 4A:
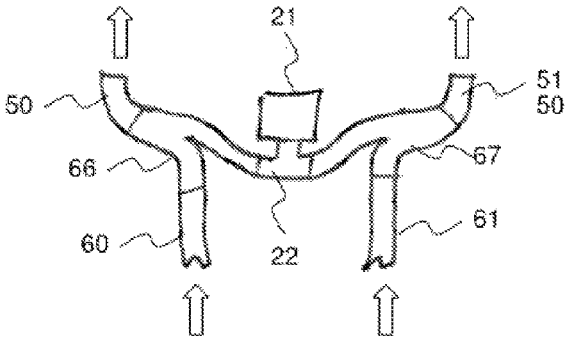
FIG. 4A is a schematic illustration showing the connection of the sound generator of the anti-noise system of FIGS. 3A, 3B, 3C to the exhaust system of an internal combustion engine according to one of four embodiments of the invention.
Figure 4B:
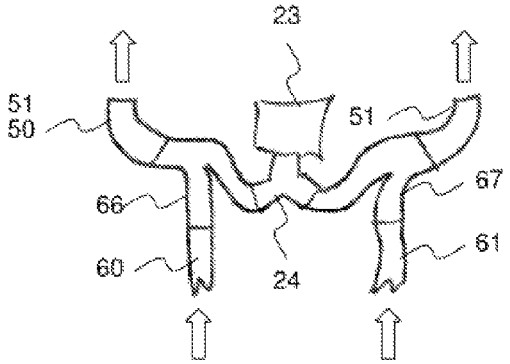
FIG. 4B is a schematic illustration showing the connection of the sound generator of the anti-noise system of FIGS. 3A, 3B, 3C to the exhaust system of an internal combustion engine according to another of four embodiments of the invention.
Figure 4C:
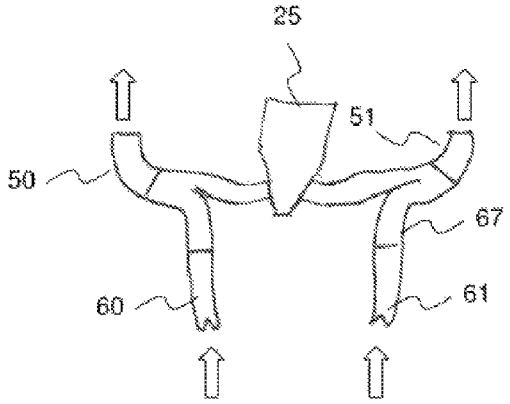
FIG. 4C is a schematic illustration showing the connection of the sound generator of the anti-noise system of FIGS. 3A, 3B, 3C to the exhaust system of an internal combustion engine according to another of four embodiments of the invention.

According to the embodiments of all FIGS. 4A, 4B, and 4C, the tailpipes 50, 51 are connected to respective corresponding exhaust tracts 60, 61 by Y-shaped manifolds 66, 67. The base or root, respectively, of each Y-shaped manifold 66, 67 is connected to a corresponding tailpipe 50, 51, and a leg of the Y-shaped manifold is connected to a conduit of the respective exhaust tract 60, 61. The other leg of the Y-shaped manifold 66, 67 is in fluid communication with the respective sound generator 21, 23, 25. The acute angle between the legs of the Y-shaped manifold 66, 67 prevents the loudspeaker of the corresponding sound generator 21, 23, 25 from being affected by the pressure of the exhaust gas passing through the exhaust tracts 60, 61.

According to the embodiment of FIG. 4A, the fluid connection of the sound generator 21 is achieved with a T-shaped adapter 22 which both legs are connected to the legs of the Y-shaped manifolds 66, 67, and which base is connected to the sound generator 21.

According to the embodiment of FIG. 4B, the fluid connection of the sound generator 23 is achieved with a Y-shaped adapter 24 which both legs are connected to the legs of the Y-shaped manifold 66, 67, and which base is connected to the sound generator 23.

According to the embodiment of FIG. 4C, the sound generator 25 comprises an antechamber volume into which the two legs of the Y-shaped manifolds 66, 67 enter.

Figure 4D:
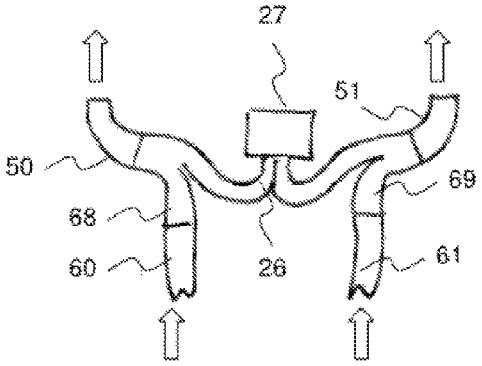
FIG. 4D is a schematic illustration showing the connection of the sound generator of the anti-noise system of FIGS. 3A, 3B, 3C to the exhaust system of an internal combustion engine according to another of four embodiments of the invention.

Also in the embodiment of FIG. 4D, the two tailpipes 50, 51 are connected to the respective corresponding exhaust tracts 60, 61 by Y-shaped manifolds 68, 69 with the base or root, respectively, of each Y-shaped manifold 68, 69 being connected to a corresponding tailpipe 50, 51, and a leg of the Y-shaped manifold 68, 69 being connected to a conduit of the respective exhaust tract 60, 61. The other legs of the Y-shaped manifold 68, 69 are configured as a twin D-pipe near the connection to the sound generator 27. Near the connection to the sound generator 27, each of the other legs of the Y-shaped manifolds 68, 69 have thus a semicircular cross section, with the flat sides put together and joined by a welding seam.

According to the embodiments of all FIGS. 4A, 4B, 4C, and 4D, the lengths of the respective conduits between the respective exhaust tracts 60, 61 and the sound generator 21, 23, 25, 27 are identical.

The error microphone(s) used are not shown in FIGS. 4A to 4D. As shown in FIGS. 3A to 3C, there are the options:

- to provide one error microphone that is disposed along the exhaust gas flow downstream of the region, where the fluid connection of the respective sound generator 21, 23, 25, 27 to the exhaust tracts 60, 61 is effected, and which is associated with one of the two exhaust tracts 60, 61; or
- to provide two error microphones, each being associated to one of the two exhaust tracts 60, 61 and disposed along the exhaust gas flow downstream of the region, where the fluid connection of the respective sound generator 21, 23, 25, 27 to the exhaust tracts 60, 61 is effected; or
- to provide one error microphone associated to both exhaust tracts 60, 61 simultaneously and being connected to these by a fluid connection disposed along the exhaust gas flow downstream of the region, where the fluid connection of the respective sound generator 21, 23, 25, 27 to the exhaust tracts 60, 61 is effected.

Figure 4E:
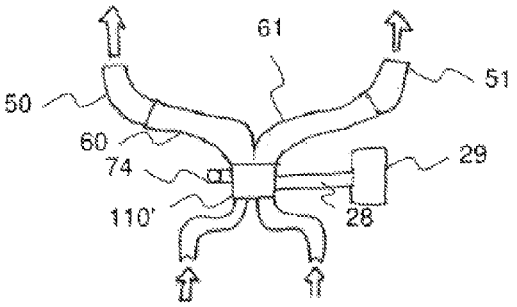
FIG. 4E is a schematic illustration showing the connection of the sound generator of the anti-noise system of FIGS. 3A, 3B, 3C to the exhaust system of an internal combustion engine according to still another embodiment of the invention.

According to the embodiment of FIG. 4E, the sound generator 29 is in fluid communication with a volume 110' through a conduit 28, with the volume 110' being shared by the two exhaust tracts 60, 61. This volume 110' is located along the exhaust gas passing through the exhaust tracts 60, 61 downstream of the internal combustion engine 100 and upstream of the tailpipes 50, 51. In the embodiment shown, the volume 110' is located downstream of a turbocharger (not shown). Further, an error microphone 74 is provided which is in fluid communication with the volume 110' downstream (with respect to the exhaust gas flow) of the region of the fluid connection of the sound generator 29 to the volume 110'. Furthermore, the error microphone 74 is connected to the controller 80.

Figure 5:
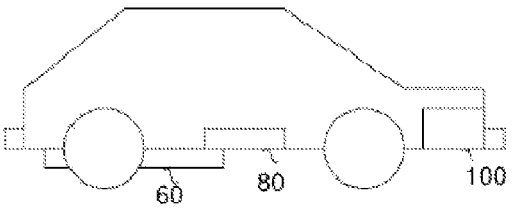
FIG. 5 is a schematic illustration showing a motor vehicle comprising an exhaust system with an anti-noise system according to the invention.

Referencing FIG. 5, a motor vehicle is shown that houses an internal combustion engine 100 and in addition the above anti-noise system with the multi-flow exhaust system (of which only the exhaust tract 60 is shown in FIG. 5) and the anti-noise controller 80. The sound generator with the loudspeaker is not shown in FIG. 5.

While the disclosure has been described with respect to certain exemplary embodiments thereof, it is evident that many alternatives, modifications and variations will be apparent to those skilled in the art. Accordingly, the exemplary embodiments of the disclosure set forth herein are intended to be illustrative and not limiting in any way.

Various changes may be made without departing from the spirit and scope of the present disclosure as defined in the following claims.

What is claimed is:

1. An anti-noise system for influencing exhaust noises propagating through a multi-flow exhaust system of a vehicle comprising at least two exhaust tracts, the anti-noise system comprising:

a controller;

a sound generator;

at least one actuator disposed in the sound generator, the at least one actuator being in communication with the controller for receiving control signals, and the at least one actuator being configured for generating sound inside the sound generator;

an error microphone that is in communication with the controller, wherein:

the sound generator is connectable to at least two exhaust tracts of the multi-flow exhaust system of the vehicle simultaneously;

the controller is configured to generate a control signal that prompts the at least one actuator disposed in the sound generator to cancel sound inside the at least two exhaust tracts of the vehicle's multi-flow exhaust system in amplitude at least in part or completely;

the error microphone is adapted to measure sound inside the exhaust system and to output a corresponding measurement signal to the controller;

the controller is configured to cancel measurement signals received from the error microphone by outputting the control signal to the at least one actuator at least in part or completely;

the error microphone is connectable by an additional pipe to the at least two exhaust tracts of the vehicle's multi-flow exhaust system simultaneously at a position of the exhaust system located in a section of a fluid connection between the sound generator and the exhaust system.

2. The anti-noise system according to claim 1, wherein:

the controller is connectable to an engine control unit of an internal combustion engine of the vehicle; and the controller is configured to generate the digital control signal subject to signals received from the engine control unit.

3. The anti-noise system according to claim 1, wherein at least one of:

the system comprises exactly one actuator;

the system comprises exactly one error microphone;

the system comprises exactly one controller.

4. The anti-noise system according to claim 1, wherein the sound generator comprises a twin D-pipe, wherein both D-pipes of the twin D-pipe are in fluid communication with the interior volume of the sound generator and each one of the D-pipes of the twin D-pipe is connectable to just one exhaust tract of the multi-flow exhaust system of the vehicle.

5. The anti-noise system according to claim 1, wherein the sound generator comprises a Y-pipe, with one leg of the Y-pipe being in fluid communication with the interior volume of the sound generator, and one of the remaining legs of the Y-pipe being each connectable to just one exhaust tract of the multi-flow exhaust system of the vehicle.

6. The anti-noise system according to claim 1, wherein the sound generator comprises an antechamber volume into which several connection pipes enter, whereby each connection pipe is connectable to exactly one exhaust tract of the multi-flow exhaust system of the vehicle.

7. The anti-noise system according to claim 1, wherein one end of the additional pipe engages one of the at least two exhaust tracts and another end of the additional pipe engages another one of the at least two exhaust tracts.

8. The anti-noise system according to claim 1, wherein the additional pipe and the error microphone are located downstream of the sound generator with respect to a flow of exhaust fluid in at least one of the at least two exhaust tracks.

9. The anti-noise system according to claim 1, wherein one of the at least two exhaust tracts comprises a first exhaust track end portion, wherein a first flow of exhaust fluid exits the one of the at least two exhaust tracts via the first exhaust track end portion, another one of the at least two exhaust tracts comprising a second exhaust track end portion, wherein a second exhaust track fluid exits the another one of the at least two exhaust tracts via the second exhaust track end portion, the additional pipe and the error microphone being located between the sound generator, the first exhaust track end portion and the second exhaust track end portion.

10. A multi-flow exhaust system for a vehicle, comprising:

a first exhaust tract for connecting to an internal combustion engine of the vehicle and adapted to have at least a portion of exhaust gas discharged from the internal combustion engine pass through the first exhaust tract;

a second exhaust tract for connecting to the internal combustion engine of the vehicle and adapted to have at least a portion of exhaust gas discharged from the internal combustion engine pass through the second exhaust tract, wherein each of the exhaust tracts comprise a tailpipe through which exhaust gas passing through the respective exhaust tract is discharged to the outside of the exhaust system; and an anti-noise system comprising:

a controller;

a sound generator;

an actuator disposed in the sound generator, the actuator being operatively connected with the controller for receiving control signals, the actuator being configured for generating sound inside the sound, generator;

an additional pipe connected to each of the first exhaust tract and the second exhaust tract;

an error microphone operatively connected with the controller, wherein:

the sound generator is connected to each of the first exhaust tract and the second exhaust tract;

the controller is configured to generate a control signal that prompts the actuator to cancel sound inside the first exhaust tract and the second exhaust tract, in amplitude, at least in part or completely simultaneously;

the error microphone measures sound inside the exhaust system and provides an output of a corresponding measurement signal to the controller;

the controller is configured to cancel measurement signals received from the error microphone by outputting the control signal to the actuator at least in part or completely;

the error microphone is connected by the additional pipe to the first exhaust tract and the second exhaust tract simultaneously at a position of the exhaust system located in a section of a fluid connection between the sound generator and the exhaust system.

11. The multi-flow exhaust system for a vehicle according to claim 10, wherein the lengths of the first exhaust tract and the second exhaust tract, of the multi-flow exhaust system between the internal combustion engine and the position along the respective exhaust tract at which the sound generator is connected to the respective exhaust tract are identical, and the lengths of all connection pipes between the respective exhaust tract and the sound generator are identical.

12. The multi-flow exhaust system for a vehicle according to claim 10, wherein the first exhaust tract and the second exhaust tract comprise a shared volume that is located with respect to the flow direction of the exhaust gas passing through the exhaust tracts upstream of the section of the fluid connection between the sound generator and the exhaust system and downstream of the internal combustion engine.

13. The multi-flow exhaust system for a vehicle according to claim 10, wherein:

the first exhaust tract and the second exhaust tract comprise a shared volume that is located upstream of the tailpipes and downstream of the internal combustion engine with respect to the flow direction of exhaust gas passing through the exhaust tracts; and the sound generator is disposed in the region of the shared volume and thus simultaneously connected to both of the first exhaust tract and the second exhaust tract of the multi-flow exhaust system of the vehicle.

14. The multi-flow exhaust system for a vehicle according to claim 10, wherein the first exhaust tract and the second exhaust tract comprise a shared volume that is located upstream of the tailpipes and downstream of the internal combustion engine with respect to the flow direction of exhaust gas passing through the exhaust tracts; and the sound generator is disposed in the region of the shared volume and thus simultaneously connected to both of the at least two exhaust tracts of the multi-flow exhaust system of the vehicle.

15. The multi-flow exhaust system for a vehicle according to claim 10, in combination with internal combustion engine to provide a vehicle wherein:

the internal combustion engine has an engine control unit;

the multi-flow exhaust system is in fluid communication with the internal combustion engine; and the controller of the anti-noise system is in communication with the engine control unit of the internal combustion engine of the vehicle.

16. The anti-noise system according to claim 10, wherein the additional pipe and the error microphone are located downstream of the sound generator with respect to a flow of exhaust fluid in at least one of the first exhaust tract and the second exhaust track.

17. The anti-noise system according to claim 10, wherein the first exhaust track comprises a first exhaust track end portion, wherein first exhaust track fluid exits the first exhaust track via the first exhaust track end portion, the second exhaust track comprising a second exhaust track, wherein second exhaust track fluid exits the second exhaust track via the second exhaust track end portion, the additional pipe and the error microphone being located between the sound generator, the first exhaust track end portion and the second exhaust track end portion.

18. A method for controlling an anti-noise system for influencing exhaust noises propagating through a multi-flow exhaust system of the vehicle, the method comprising the steps of:

providing an anti-noise system comprising a controller, a sound generator and an actuator disposed in the sound generator, the actuator being operatively connected with the controller for receiving control signals, the actuator being configured for generating sound inside the sound generator, wherein the sound generator is connected to each of a first exhaust tract and a second exhaust tract and the controller is configured to generate a control signal that prompts the actuator to cancel sound inside the first exhaust tract and the second exhaust tract, in amplitude, at least in part or completely;

at least one of receiving an operating parameter from an engine control unit of the vehicle and measuring sound inside the exhaust system;

calculating a control signal subject to at least one of operating parameters and the sound measured, the control signal being adapted to cancel the airborne sound passing through the first exhaust tract and the second exhaust tract of the multi-flow exhaust system at least in part or completely;

generating airborne anti-noise by operating at least one actuator with the control signal;

providing an additional pipe connected to each of the first exhaust tract and the second exhaust tract;

providing an error microphone operatively connected with the controller; and supplying the generated airborne anti-noise to the first exhaust tract and the second exhaust tract of the multi-flow exhaust system simultaneously, wherein:

the error microphone measures sound inside the exhaust system and provides an output of a corresponding measurement signal to the controller;

the controller is configured to cancel measurement signals received from the error microphone by outputting the control signal to the actuator at least in part or completely;

the error microphone is connected by the additional pipe to the first exhaust tract and the second exhaust tract simultaneously at a position of the exhaust system located in a section of a fluid connection between the sound generator and the exhaust system; and connecting the sound generator to the first exhaust tract and the second exhaust tract.

19. The method according to claim 18, wherein the additional pipe and the error microphone are located downstream of the sound generator with respect to a flow of exhaust fluid in at least one of the first exhaust tract and the second exhaust track.

20. The method according to claim 19, wherein the first exhaust track comprises a first exhaust track end portion, wherein first exhaust track fluid exits the first exhaust track via the first exhaust track end portion, the second exhaust track comprising a second exhaust track end portion, wherein second exhaust track fluid exits the second exhaust track via the second exhaust track end portion, the additional pipe and the error microphone being located between the sound generator, the first exhaust track end portion and the second exhaust track end portion.

* * * * *